US006144820A

United States Patent [19]

Ishii et al.

[11] Patent Number: 6,144,820

[45] Date of Patent: Nov. 7, 2000

[54] DEVELOPING APPARATUS WITH A SEALING MEMBER HAVING AN INSULATING LAYER AND A CONDUCTIVE PORTION

[75] Inventors: Yasuyuki Ishii, Mishima; Kenji Matsuda, Numazu; Kouji Hashimoto, Shizuoka-ken; Akiyoshi Fujita; Nobuharu Hoshi, both of Numazu; Norio Takami, Mishima; Tadashi Horikawa, Susono, all of Japan

[73] Assignee: Canon Kabushiki Kaisha, Tokyo, Japan

[21] Appl. No.: 09/290,265

[22] Filed: Apr. 13, 1999

[30] Foreign Application Priority Data

Apr. 17, 1998 [JP] Japan ..... 10-124128
May 29, 1998 [JP] Japan ..... 10-165908

[51] Int. Cl.[7] ..... G03G 15/00; G03G 15/08

[52] U.S. Cl. ..... 399/90; 399/103

[58] Field of Search ..... 399/90, 103, 105, 399/285

[56] References Cited

U.S. PATENT DOCUMENTS 5,477,006 12/1995 Imamiya et al. ..... 399/285
5,592,265 1/1997 Sakuraba et al. ..... 399/285
5,600,419 2/1997 Sakuraba et al. ..... 399/285
5,937,236 8/1999 Kim ..... 399/103

FOREIGN PATENT DOCUMENTS 54-43038 4/1979 Japan .
59-53856 3/1984 Japan .

*Primary Examiner*—William J. Royer
*Attorney, Agent, or Firm*—Fitzpatrick, Cella, Harper & Scinto

[57] ABSTRACT

The present invention relates to a developing apparatus which has a developer container, a developer bearing member and a developer sealing member. Also, it is mainly featured that at least a part of the developer sealing member is a conductive portion, and the developer bearing member and the conductive portion have a same potential when a voltage is applied to the developer bearing member.

22 Claims, 12 Drawing Sheets

DEVELOPING APPARATUS WITH A SEALING MEMBER HAVING AN INSULATING LAYER AND A CONDUCTIVE PORTION

BACKGROUND OF THE INVENTION

1. Field of the Invention

The present invention relates to a developing apparatus and a process cartridge containing at least such developing apparatus, adapted for use in an image forming apparatus such as an electrophotographic copying apparatus or an electrophotographic printer.

2. Related Background Art

In an image forming apparatus performing an electrophotographic process, an electrostatic latent image formed on an image bearing member is visualized as a toner image by a developing apparatus. Among such developing apparatus there have been proposed one-component dry developing apparatus of various types, but, in any of these apparatus, it is difficult to form a thin layer of toner constituting the one-component developer on the developer bearing member.

However, improvement in resolution and clearness of the image is now being desired, the development of the method for forming a thin toner layer and the apparatus therefor are essential and there have been made several proposals.

For example Japanese Patent Application Laid-open No. 54-43038 proposes an apparatus in which a metal or rubber elastic blade is abutted against a developing sleeve constituting a developer bearing member to regulate the toner layer by passing the toner between the elastic blade and the developing sleeve, thereby a thin toner layer is formed on the developing sleeve and the toner is provided with sufficient triboelectricity by friction in the contacting portion.

In such case, if the above-mentioned elastic blade regulates non-magnetic toner, there is separately required a toner supply member for supplying the toner onto the developing sleeve. This is because the non-magnetic toner cannot be supplied by magnetic force, though magnetic toner can be supplied onto the developing sleeve by the magnetic force of the magnet provided in the developing sleeve.

For this reason, there has been proposed a developing apparatus 50 shown in FIG. 18. In this conventional developing apparatus 50, in a developer container 54 containing non-magnetic toner 53 as the one-component developer, an elastic roller 55 composed of a foamed member such as of polyurethane foam or sponge or fur brush is provided abutting against a developing sleeve 52 at the upstream position, in the rotating direction thereof, of an elastic blade 51, and is rotated in a direction D to feed the toner 53 onto the developing sleeve 52.

The toner 53 fed onto the developing sleeve 52 is supplied, by the rotation thereof, to the contact (abutting) area between the elastic blade 51 and the developing sleeve 52, thus being formed into a thin layer, and is used for developing the electrostatic latent image borne on a photosensitive drum 1 serving as the image bearing member. Then, the toner 53 not consumed in the image development but remaining on the developing sleeve 52 is peeled off by the elastic roller 55 while new toner 53 is fed onto the developing sleeve 52 as described in the foregoing, and these operations are repeated. If the developing sleeve 52 is composed of a metallic material, the elastic blade 51 of a thin metal plate is no desirable in consideration of the abrasion of the developing sleeve, and it has to be formed with a rubber material such as urethane rubber or silicone rubber or the like in order to obtain a satisfactory thin layer of toner.

Such configuration allows a satisfactory thin layer of non-magnetic toner to be formed on the developing sleeve. However, in comparison with the magnetic developing apparatus employing magnetic toner and capable of easily holding toner on the surface of the developing sleeve by the function of the magnetic field, it becomes difficult to prevent the leakage of toner 53 from the developing apparatus 50 because the non-magnetic toner does not allow the magnetic attractive force. To be utilized more specifically, the developing sleeve 52 can only hold the toner which has passed the abutting area between the elastic blade 51 and the developing sleeve 52 and has been given sufficient triboelectricity, with the results that toner may easily leak from the lower part or end portions of the developing sleeve 52 to the exterior, resulting in smear of the interior of the image forming apparatus with toner.

For this reason, a flexible developer sealing member (hereinafter simply called seal member) 56 abutting against the developing sleeve 52 with small pressure is provided at the toner recovering portion in the lower part of the developer container 54, in order to permit the passage of the toner not used in the image development and to prevent leakage of the toner 53 from the lower part of the developer container 54.

The above-described developing apparatus has been employed in compact copying machines and page printers, but is recently utilized as a developing unit or a process cartridge integrally containing the developing apparatus and the photosensitive drum eventually with the cleaner and/or the charging device.

In the above-mentioned cartridge or developing unit, the developing apparatus is provided with various sealings since the toner may leak by the impact given in the developing apparatus at the replacement thereof. In particular, in an aperture for collecting the unused toner or the developing sleeve 52 into the developing apparatus, a seal member 56 is provided for preventing the leakage of toner from the developing apparatus without hindering collecting of toner.

As shown in FIG. 19, the seal member 56 is composed of a strip-shaped sheet, which is wider than the developing area of the developing sleeve 52, and is fixed at an end to a lower frame 57 of the developing apparatus and is in frictional contact at the free end by the elasticity thereof with the developing sleeve 52, along the rotating direction thereof. The seal member 56 is composed of a thin urethane rubber or a polycarbonate film of low rigidity or PET (polyethylene terephthalate) or the like. The seal member 56 bends toward the interior of the developing apparatus as indicated by an arrow in FIG. 20, thereby it does not hinder collecting of the toner. Also the seal member 56 is inclose contact with the developing sleeve 52 and or events toner blowing from the interior of the developing apparatus, thus preventing toner leakage.

However, when the developing operation is repeated many times with the conventional developing apparatus described above, the toner 53, having a high charge amount because of one-component non-magnetic toner, eventually charges the entire surface of the frame 57 and the developer container 54. Experimentally it is found that most of the frame 57 in the longitudinal direction thereof tends to be charged in a polarity opposite to that of the toner 53. Consequently, in such charged portion, under the application of the developing bias, there will result an electric field in a direction to strip the toner 53 from the developing sleeve 52 toward the seal member 56 at the toner collecting operation. Thus the toner 53 at the collecting operation remains on the seal member 56 and drops off to badly smear the interior of the image forming apparatus, thus resulting in so-called toner leakage.

Also, when the developing operation is repeated many times with the conventional developing apparatus described above, there will result impact and vibration in the image forming apparatus, and such impact and vibration are applied to the developing apparatus to deform the frame 57 and the seal member 56 provided thereon, thereby generating a gap in the contact area with the developing sleeve 52 and eventually resulting in severe smear of the interior of the image forming apparatus.

SUMMARY OF THE INVENTION

In consideration of the foregoing, a principal object of the present invention is to provide a developing apparatus capable of preventing leakage of the developer from the aperture portion of the developer container or the developer bearing member, a process cartridge containing at least such developing apparatus, and an image forming apparatus equipped with such developing apparatus.

Another object of the present invention is to provide a developing apparatus capable of preventing deterioration of the sealing property even in case the developer seal member is deformed by the deformation of the developing apparatus resulting from repetition of the developing operation, a process cartridge containing at least such developing apparatus, and an image forming apparatus equipped with such developing apparatus.

DETAILED DESCRIPTION OF THE PREFERRED EMBODIMENTS

Now the developing apparatus and the process cartridge of the present invention will be explained in detail with reference to the attached drawings.

Embodiment 1

Figure 1:
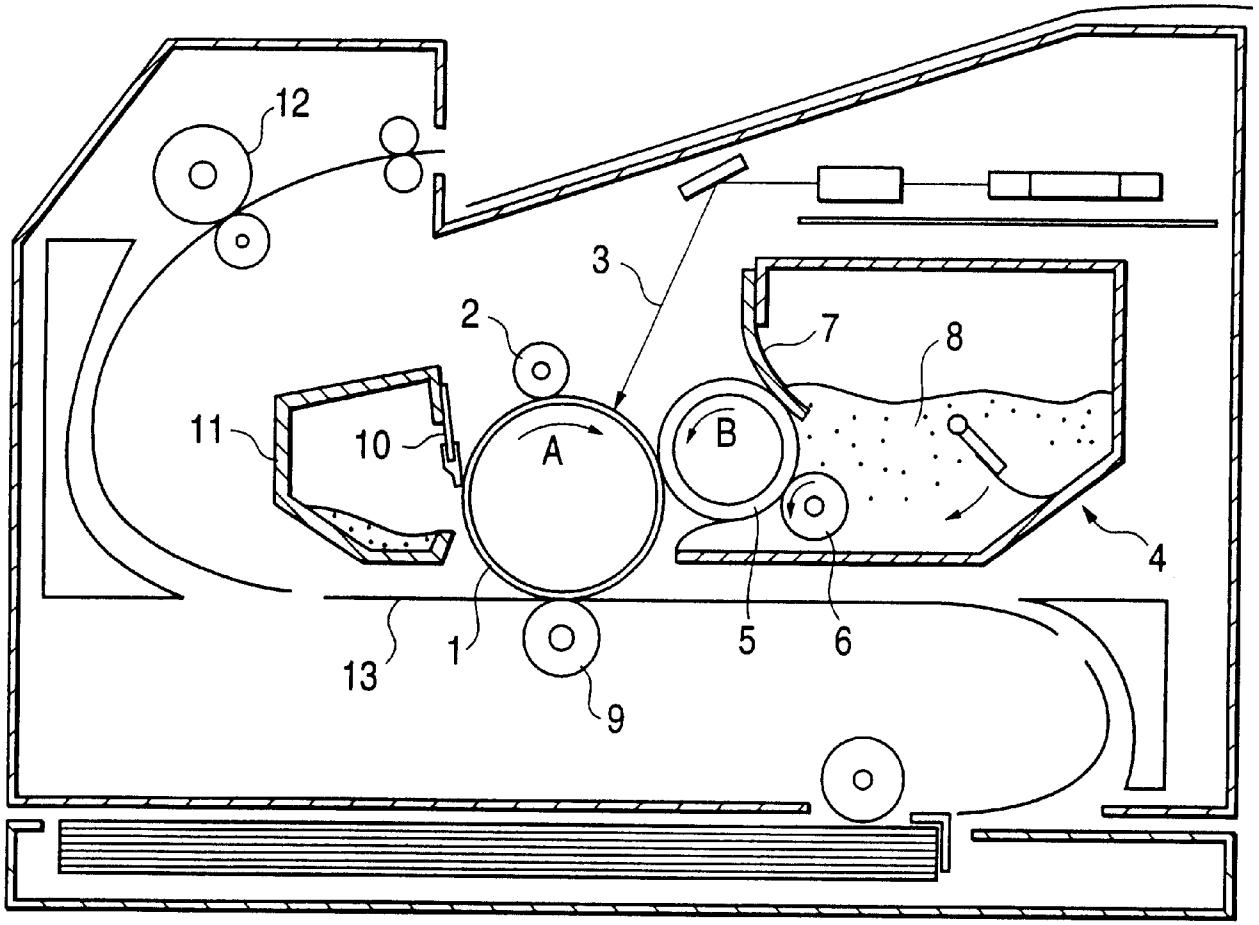
FIG. 1 is a schematic view showing the configuration of an image forming apparatus equipped with a developing apparatus constituting a first embodiment of the present invention.

A first embodiment of the present invention will be explained with reference to FIGS. 1 to 5. FIG. 1 shows the image forming apparatus of the present embodiment.

Referring to FIG. 1, a photosensitive drum 1 constituting the image bearing member is rotated in a direction A, then uniformly charged with a charging device 2 for charging the photosensitive drum 1 and is exposed by a laser beam 3 from a laser scanner constituting exposure means to form an electrostatic latent image on the surface thereof.

The electrostatic latent image is developed by a developing apparatus 4, which is positioned close to the photosensitive drum 1 and is detachably attachable as a process cartridge to the main body of the image forming apparatus, thus visualized as a toner image. The present embodiment employs so-called reversal development for forming the toner image in the exposed area (low potential area).

The visualized toner image on the photosensitive drum 1 is transferred by a transfer roller 9 onto a paper sheet 13 constituting the recording medium, while the toner remaining on the photosensitive drum 1 after the transfer is scraped off by a cleaning blade 10 and contained in a waste toner container 11, and the cleaned photosensitive drum 1 is used again for image formation by the repetition of the above-described steps.

On the other hand, the sheet 13 with the transferred toner image is subjected to a fixing process by a fixing device 12 and is then discharged from the apparatus, whereby the printing operation is completed.

Figure 2:
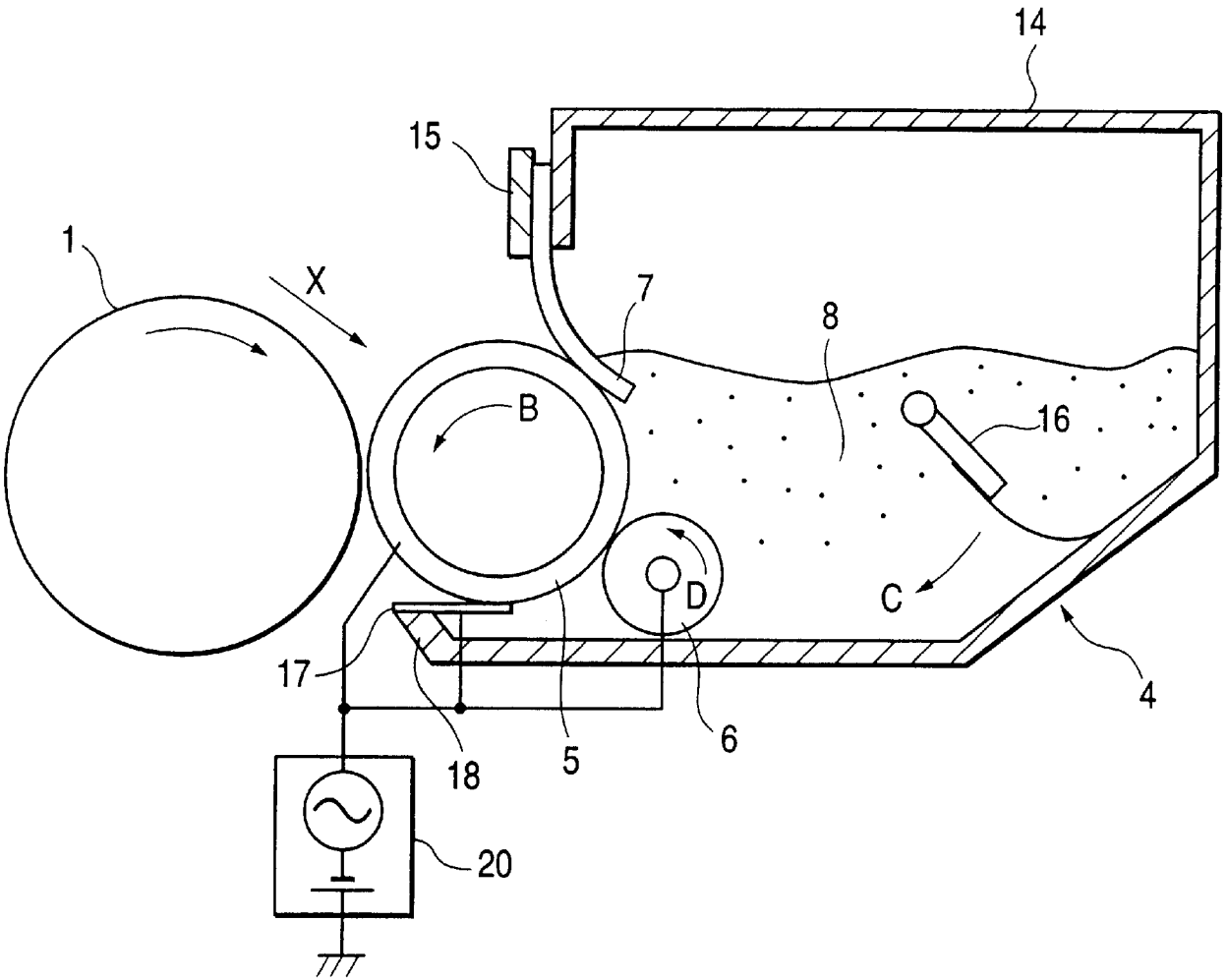
FIG. 2 is a schematic view showing the configuration of the developing apparatus of the first embodiment.

Now reference is made to FIG. 2 for further explaining the developing apparatus 4 of the present embodiment.

The developing apparatus 4 is provided with a developer container 14 containing non-magnetic toner 8 serving as one-component developer, and a developing sleeve 5, serving as the developer bearing member, opposed to the photosensitive drum 1 is mounted on an aperture extending in the longitudinal direction of the developer container and develops, the electrostatic latent image on the photosensitive drum 1.

The developing sleeve 5 is so positioned at the aperture that an approximate half of the periphery at the right hand side in FIG. 2 is located in the developer container 14 while an approximate half of the periphery at the left hand side is exposed to the exterior of the developer container 14. The surface exposed from the developer container 14 is opposed, with a small gap, to the photosensitive drum 1 which is positioned at the left hand side in the developing apparatus 4.

Figure 3:
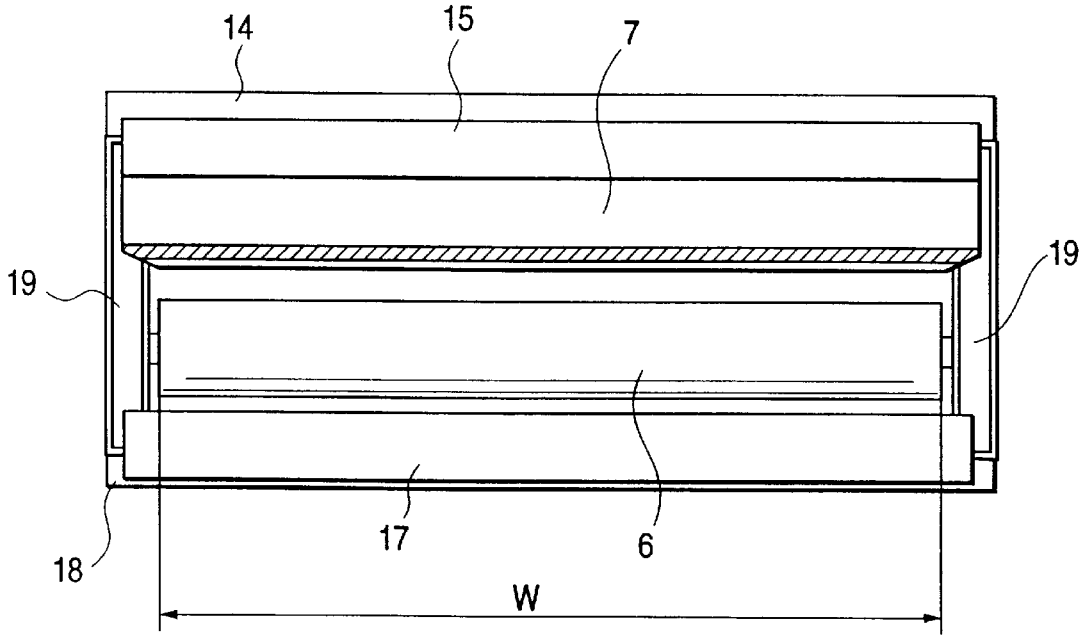
FIG. 3 is a view of the developing apparatus of the first embodiment, without the developing sleeve, seen from a direction X shown in FIG. 2.

The developing sleeve 5 is rotated in a direction B and the surface thereof is provided with appropriate irregularities in order to increase the probability of friction with the toner 8 and to achieve satisfactory carriage thereof. In the present embodiment, the developing sleeve 5 is composed of an aluminum sleeve of a diameter of 20 mm, subjected to surface blasting with glass beads (#600) to a surface roughness Ra of about 0.8 $\mu$m. It is opposed to the photosensitive drum 1 with a gap of 300 $\mu$m therebetween and is rotated with a peripheral speed of 80 mm/s which is somewhat larger than that of 50 mm/s of the photosensitive drum 1. In order to prevent toner leakage from both ends, in the longitudinal direction, of the developing sleeve 5, the both ends thereof are sealed by end seal members 19 provided in the aperture of the developer container 14 as shown in FIG. 3.

Again referring to FIG. 2, above the developing sleeve 5, there is provided an elastic blade 7 which is composed of a rubber material, such as urethane rubber or silicone rubber or the like, or of a thin metal plate such as SUS (stainless steel) or phosphor bronze, as a base body and a rubber material adhered to the surface thereof abutted against the developing sleeve 5, and is supported by a blade supporting metal plate 15. The elastic blade 7 is so supported as to be abutted in surfacial contact, in the vicinity of the free end thereof, with the external periphery of the developing sleeve 5 in so-called counter direction, namely in such a direction that the front end in the contact area is positioned at the upstream side in the rotating direction of the developing sleeve 5.

In the present embodiment, the elastic blade 7 is composed of plate-shaped urethane rubber of a thickness of 1.0 mm adhered to the blade supporting metal plate 15 and a contact pressure to the developing sleeve 5 is set as 25 to 35 g/cm (linear pressure is converted from the force required by a spring scale to extract the central plate from three thin metal plates of known frictional coefficient inserted into the contact area).

An elastic roller 6 is rotatably supported and abutted against the developing sleeve 5, at the upstream side, in the rotating direction thereof, of the contact position between the surface of the developing sleeve 5 and the elastic blade 7. The elastic roller 6 preferably has a foamed structure like sponge or a fur brush structure formed by planting fibers such as rayon or nylon on a metal core, in consideration of the toner supply to the developing sleeve 5 and peeling of the undeveloped (unused) toner. In the present embodiment, there is employed an elastic roller 6 of a diameter of 18 mm, having polyurethane form on a metal core.

The elastic roller 6 effectively has a contact width of 1 to 8 mm with the developing sleeve 5, and preferably has a relative speed to the developing sleeve 5 at the contact area therewith. In the present embodiment, the contact width is selected as 3 mm, and the elastic roller 6 is rotated at a predetermined timing by drive means (not shown) so as to have a peripheral speed of 50 mm/s at the developing operation (with a relative speed of 130 mm/s to the developing sleeve 5).

FIG. 3 is a view of the developing apparatus 4, seen in a direction X shown in FIG. 2, wherein the developing sleeve 5 is omitted for the purpose of simplicity.

As shown in FIG. 3, the elastic blade 7 is so formed that the distance from the contact nip thereof with the developing sleeve 5, indicated by a hatched area, to the front end of the elastic blade 7 becomes shorter continuously from the ordinary developing area toward the both ends of the elastic blade 7 and that the front end thereof at both ends is contained in the contact nip mentioned above.

It is conventionally known that the thickness of the toner layer formed on the developing sleeve 5 is influenced by the distance from the point of the contact nip at the upstream side thereof in the rotating direction of the developing sleeve 5 to the front end of the elastic blade and becomes thicker or thinner as the above-mentioned distance becomes respectively longer or shorter, and, in the present embodiment, the regulating force on the toner layer in the above-mentioned contact area is increased by reducing the above-mentioned distance in a contact area on the periphery of the developing sleeve, corresponding to the uncontacting area of the elastic roller 6, in comparison with the above-mentioned distance in the ordinary developing area.

The toner 8 is composed of non-magnetic one-component developer, and is composed of spherical toner particles with smooth surface, which provide excellent transfer property and excellent lubricating property in cleaning the untransferred toner, remaining on the photosensitive drum 1, with cleaning means such as a blade or a fur brush, thus reducing the abrasion of the photosensitive drum 1.

Specifically, the toner has a volume resistance value of at least $10^{14}\Omega$. The volume resistance value (resistivity) is measured by measuring the current by a microammeter (YHP (Yokogawa Hewlett-Packard) 4140 pAMETER/DC VOLTAGE SOURCE) with a measuring electrode of a diameter of 6 mm or an area of 0.283 $cm^2$, a pressure of 980 $g/cm^2$ (96.1 kPa) applied by a weight of 1500 g, and a powder layer of a thickness of 0.5 to 1.0 mm and under the application of a DC voltage of 400 V and calculated from the measured resistance.

As to the shape factors, SF-1 is within a range of 100 to 180 while SF-2 is within a range of 100 to 140.

The shape factors SF-1, SF-2 are defined by arbitrarily sampling 100 toner particle images obtained by a FE-SEM (Hitachi Ltd.: S-800), analyzing the obtained image information with an image analyzer (Nireco Inc.: Luzex 3) through an interface and calculating the obtained results according to the following equations:

$$SF\text{-}1=\{(MXLNG)^2/AREA\}\times(\pi/4)\times100$$

$$SF\text{-}2=\{(PERI)^2/AREA\}\times(1/4\pi)\times100$$

wherein MXLNG is the absolute maximum length, AREA is the projected area of toner and PERI is the peripheral length.

The shape factor SF-1 indicates the sphericity, and the shape becomes from spherical to amorphous as the shape factor increases from 100. The shape factor SF-2 indicates the level of irregularity (uneveness), and the surface irregularity of the toner particle increases as the shape factor increases from 100.

As long as the toner particles remain in the above-mentioned ranges of the shape factors, the toner may be prepared not only by so-called crushing method but also by a method of direct toner formation by suspension polymerization as disclosed in Japanese Patent Application Laid-open No. 59-053856, a method of dispersion polymerization for direct toner formation by employing aqueous induction solvent in which monomer is soluble but resulting polymer is insoluble, or a method of emulsion polymerization represented by soap-free polymerization for direct toner formation by direct polymerization in the presence of an aqueous polar starting material.

In the present embodiment, there is employed a suspension polymerization method under normal or increased pressure, capable of easily controlling the shape factor SF-1 in a range of 100 to 180 and SF-2 in a range of 100 to 140 and relatively easily obtaining fine toner particles of a diameter of 4 to 8 $\mu$m with a shape particle size distribution, utilizing styrene and n-butyl acrylate as the monomer, a metal salycilate as the charge controlling agent, saturated polyester as polar resin and a coloring material to obtain suspension of colored particles of a weight averaged particle size of 7 $\mu$m.

Then hydrophobic silica is externally added by an amount of 1.5 wt. % to obtain negatively chargeable toner 8, which is excellent in the transfer property and shows low abrasion in the cleaning of the photosensitive drum 1 as explained in the foregoing.

In the developing apparatus 4 shown in FIG. 2, at the developing operation, the toner 8 in the developer container 14 is fed toward the elastic roller 6 by the rotation of an agitating member 16 in a direction C.

Then the toner is carried to the vicinity of the developing sleeve 5 by the rotation of the elastic roller 6 in a direction D. The toner supported on the elastic roller 6 is subjected to a rubbing operation by the developing sleeve 5 in the contact area thereof with the elastic roller 6, thus being given triboelectricity and sticks to the developing sleeve 5.

Subsequently, the toner 8 sticking to the developing sleeve 5 is brought, by the rotation of the developing sleeve 5 in a direction B, to the contact area under the elastic blade 7, thus being given an appropriate triboelectric charge amount and formed into a thin layer on the developing sleeve 5. The present embodiment is so conditioned as to obtain a satisfactory charge amount within a range of −60 to −20 $\mu$C/g and a satisfactory coating amount within a range of 0.4 to 1.0 mg/cm$^2$.

Then the toner layer, formed on the developing sleeve 5, is uniformly carried to a developing area opposed to the photosensitive drum 1.

In this developing area, the thin toner layer formed on the developing sleeve 5 is deposited, as the toner image, onto the electrostatic latent image on the photosensitive drum 1, under the application of an AC developing bias voltage, consisting of an AC voltage superposed with a DC voltage and applied between the developing sleeve 5 and the photosensitive drum 1 by a power source 20.

The undeveloped toner, not consumed in the developing area, is brought by the rotation of the developing sleeve 5 and collected therefrom in the lower part thereof. In such collecting area, there is provided a seal member 17 consisting of a flexible sheet.

Figure 4A:
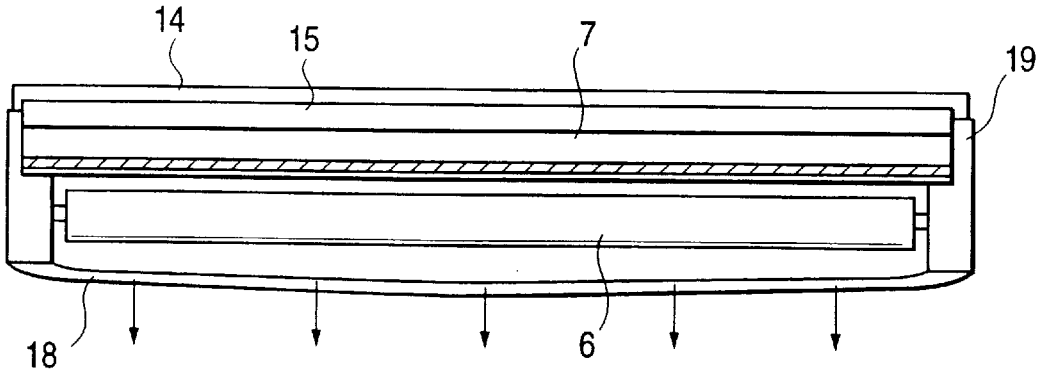
FIGS. 4A, 4B and 4C are views similar to FIG. 3, showing steps of installation of a seal member into a developer container in the first embodiment.
Figure 4B:
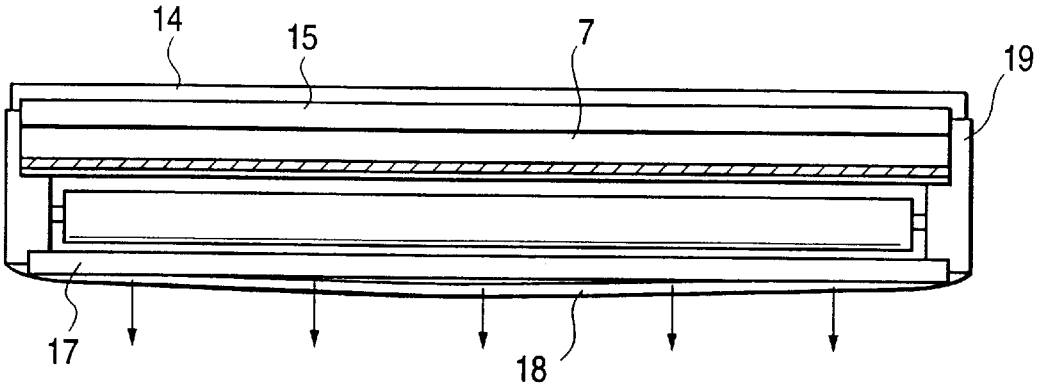

In adhering the seal member 17 to a container frame 18, in order to prevent undulating form of the seal member 17, the container frame 18 is bent as indicated by arrows in FIG. 4A and the seal member 17 is attached in such bent state as shown in FIG. 4B.

Figure 4C:
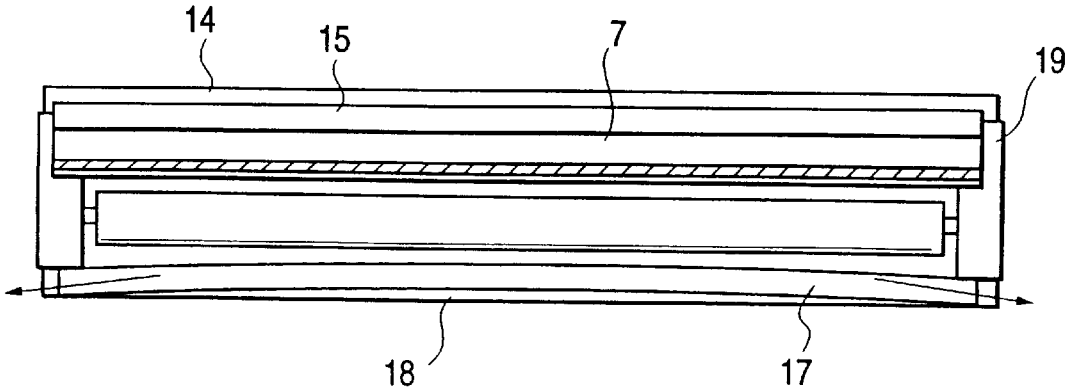

Then, the container frame 18 is released from the bending, whereby the container frame 18 returns from the deformed state to the original state to provide the seal member 17 with a tension indicated by arrows shown in FIG. 4C. Thus the seal member 17 is prevented from undulating deformation and improves the sealing for the developing sleeve 5.

As shown in FIG. 3, the seal member 17 is formed as a sheet wider in the longitudinal direction than the developing area, is fixed at an end to the container or lower frame 18 constituting a wall of the developing container 14, and is in frictional contact at the other free end by the elasticity thereof with the developing sleeve 5 so as to be along with the rotating direction thereof.

The seal member 17 can be composed of stainless steel SUS 304 as a conductive material, but it can also be composed of other metals such as phosphor bronze.

Figure 5:
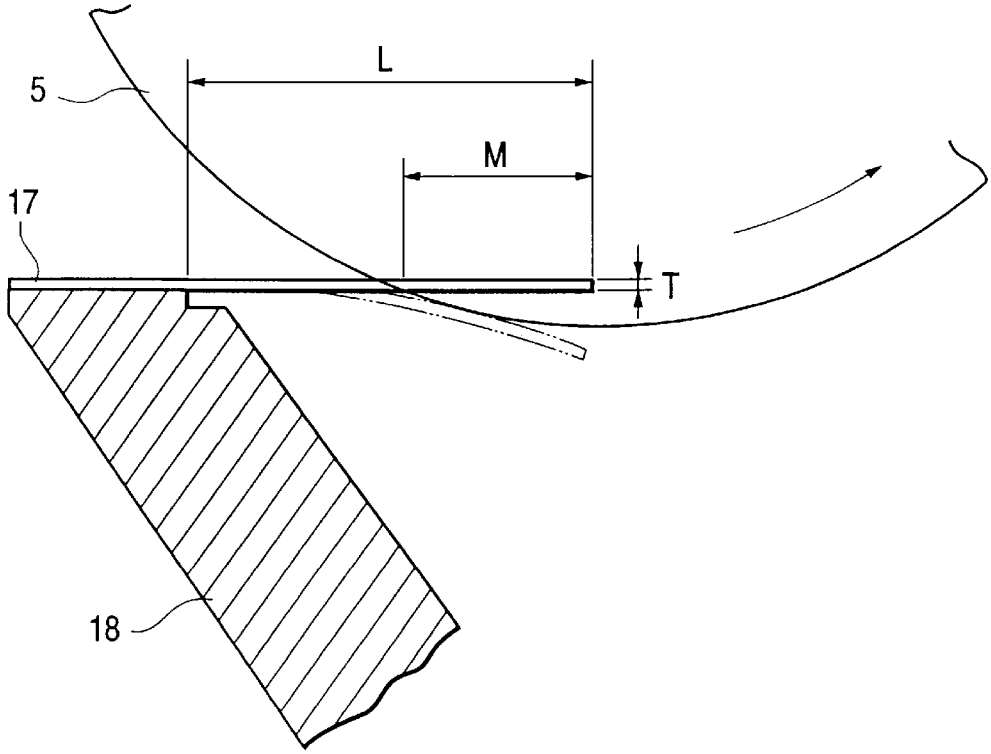
FIG. 5 is a cross-sectional view showing the contact state of the developing sleeve and the seal member in the first embodiment.

The dimension of the seal member 17 is so selected, as shown in FIG. 5, that a load point distance L of 6.7 mm, an intrusion amount M of 3.7 mm, a thickness T of 15 to 25 $\mu$m and a longitudinal length W of 335 mm.

The contact pressure of the seal member 17 to the developing sleeve 5 is 20 to 30 gF.

The seal member 17 is formed by press punching, and the entry side of the punching mold is maintained in contact with the developing sleeve 5, thereby reducing the production cost and preventing the damage to the developing sleeve by the edge of the seal member 17.

The seal member 17 may also be prepared with a rolled metal plate, thereby improving planarity of the seal member 17, ensuring compliance to the developing sleeve 5 and improving the toner recovery rate. Otherwise, it may also be composed of a sheet formed by edging, thereby improving the production yield of the seal member and securing the performance thereof.

The seal member is maintained at a potential that is the same as that of the developing sleeve, by the application of a bias voltage, similar to that for the developing sleeve 5, from the power source 20 (cf. FIG. 2). Consequently, the remaining toner, not consumed in the image development in the developing area, is returned into the developer container 14 in a constantly stable state without being subjected to a striping electric field toward the seal member 17 whereby the toner leakage from the lower part of the developing sleeve 5 can be prevented.

The present embodiment has been explained by a case of application in a process cartridge consisting of the developing apparatus detachably mountable to the main body of the image forming apparatus, but it is likewise applicable to a developing apparatus fixed in the main body of the image forming apparatus and receiving toner replenishment only, or a process cartridge integrally incorporating the developing apparatus and the photosensitive drum eventually with the cleaning blade, the waste toner container and the charging device and detachably attachable to the main body of the image forming apparatus.

Embodiment 2

In the following there will be explained a second embodiment of the present invention with reference to FIG. 6.

Figure 6:
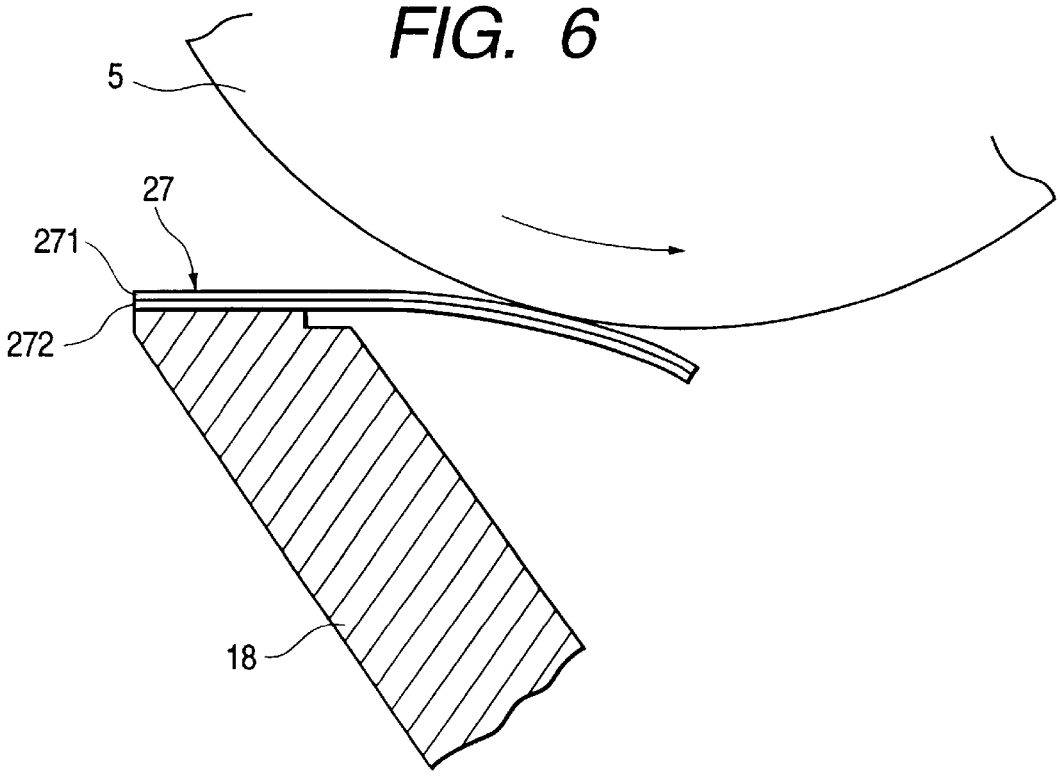
FIG. 6 is a cross-sectional view showing the contact state of the developing sleeve and the seal member in a second embodiment.

In this embodiment, the seal member 27 has a two-layered structure as shown in FIG. 6, in order to simultaneously realize conductivity and a reduced contact pressure of the seal member 27.

An upper layer (sleeve contact layer) 271 at the side of contact between the seal member 27 and the developing sleeve 5 is composed of an insulating PET (polyethylene terephthalate) sheet of a thickness of 25 $\mu$m, while a lower layer (electrode layer) 272 in contact with the lower frame 18 and positioned opposite to the upper layer 271 is composed of aluminum with a thickness of 10 $\mu$m.

Such seal member 27 can be prepared for example by coating or deposition, thereby facilitating the handling thereof at the assembling operation and improving the productivity.

As in the first embodiment, the electrode layer 272 of the seal member 27 is given a bias voltage, similar to that for the developing sleeve 5, by the power source 20 (cf. FIG. 1), thus being maintained at a potential the same as that of the developing sleeve 5.

The above-described configuration allows conductivity to be maintained in a stable manner over a prolonged period, since the lower layer 272 is not scraped off even when it is composed of a thin metal layer as the contact portion with the developing sleeve is formed by the PET sheet. Also the present configuration allows a reduction in the contact pressure between the developing sleeve 5 and the seal member 27 to 2 to 3 gF. Furthermore, the contact pressure can be selected in a much wider range, by the selection of the material and the thickness of the sleeve contact layer 271 and the electrode layer 272.

Embodiment 3

Figure 7:
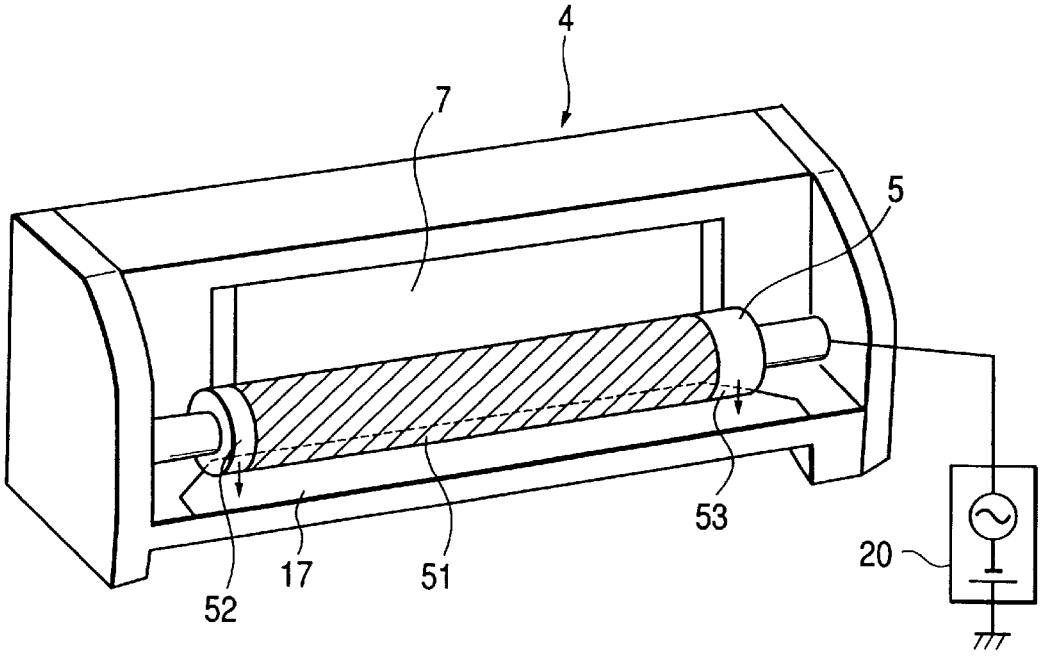
FIG. 7 is a view showing the bias applying route in a developing apparatus of a third embodiment.

In the following there will be explained a third embodiment of the present invention with reference to FIG. 7. In the foregoing embodiments, the bias voltage is applied from the power source 20 in a parallel manner to the seal member 17 and the developing sleeve 5, but, in the present embodiment, the bias voltage to the seal member 17 is applied through a route from the power source 20 to the developing sleeve 5 and then from uncoated areas 52, 53 on both sides of a coated area 51 of the developing sleeve 5 to the seal member 17. Thus, in the longitudinal direction of the developing sleeve 5, the sleeve 5 and the seal member 17 are maintained in electrical contact.

Also in this configuration, the seal member 17 in direct electrical contact with the developing sleeve 5 is maintained at the same potential as that of the developing sleeve 5, whereby effects similar to those in the foregoing embodiments can be obtained and a durable developing apparatus can be obtained with a simple configuration.

Embodiment 4

Figure 8:
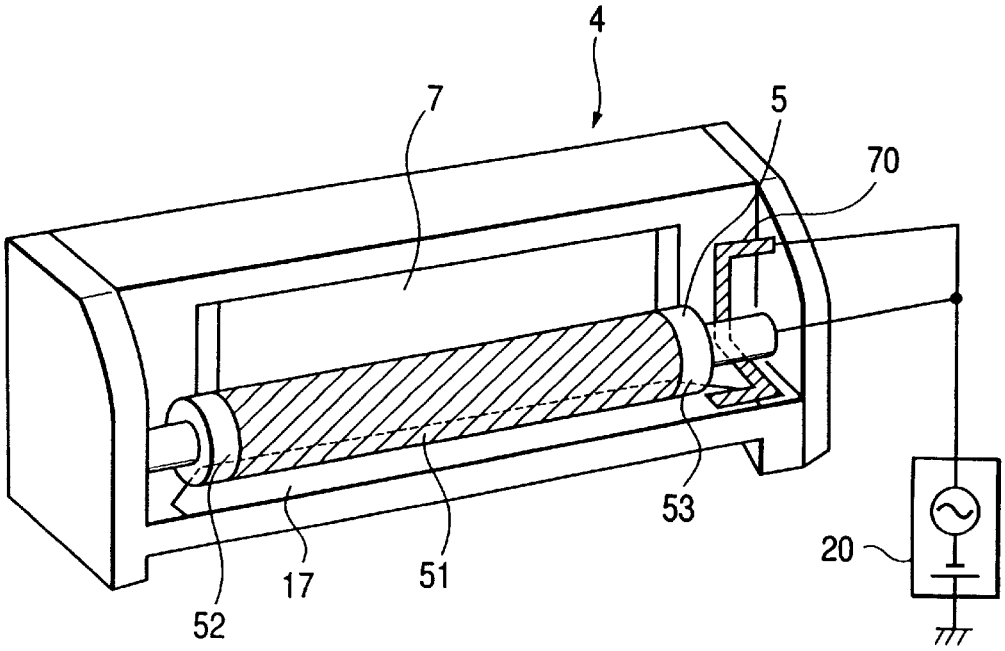
FIG. 8 is a view showing the bias applying route in a developing apparatus of a fourth embodiment.

In the following there will be explained a fourth embodiment of the present invention with reference to FIG. 8.

The present embodiment is provided with an exclusive bias applying route, in addition to the bias applying route to the seal member 17 similar to that in the third embodiment. More specifically, a seal bias metal plate 70 composed of a metal such as phosphor bronze in connected to the seal member 17 through a side opposed to the photosensitive drum 1, namely the rear side of the developing sleeve 5.

Thus the bias voltage to the seal member 17 is applied through two routes, namely a first route from the power source 20 through the uncoated areas 52, 53 of the developing sleeve 5 to the seal member 17 and an exclusive second route from the power source 20 through the seal bias metal plate 70 to the seal member 17. Thus the seal member 17 is securely maintained at the same potential as the developing sleeve 5, whereby the unused toner can be securely collected at the aperture of the developer container 14 and the toner leakage can be prevented.

The seal bias metal plate 70 is positioned at the rear side of the developing sleeve 5 particularly for space saving.

Embodiment 5

In the following there will be explained a fifth embodiment of the present invention with reference to FIGS. 9 and 10. This embodiment constitutes a further development of the seal bias metal plate 70 of the fourth embodiment.

Figure 9:
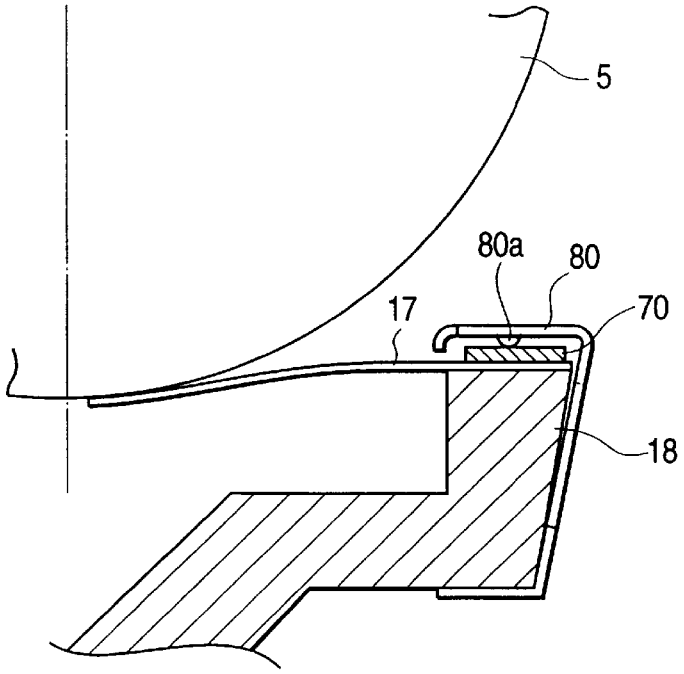
FIG. 9 is a cross-sectional view showing the contact state of the developing sleeve and the seal member and the contact portion of the seal bias metal plate in a fifth embodiment.

As shown in FIG. 9, the seal member 17 is supported at the upper end of the frame 18 of the developing container 4, but the seal bias metal plate 70 is connected to the seal member 17 by superposing with the upper surface of the seal member 17 while a metal holder 80 is provided to collectively hold the seal bias metal plate 70, the supporting portion of the seal member 17 and the frame 18. Also a projection 80*a* of a semicircular cross section is formed on the holder 80 in a contacting portion thereof with the seal bias metal plate 70.

This configuration ensures secure conduction between the seal bias metal plate 70 and the seal member 17, whereby the developing sleeve 5 and the seal member 17 are securely maintained at the same potential by the bias voltage from the power source 20, whereby the unused toner can be securely recovered at the aperture of the developer container 14 and the toner leakage can be prevented.

The metal holder 80 is preferably composed for example of phosphor bronze, but such material is not restrictive.

Figure 10:
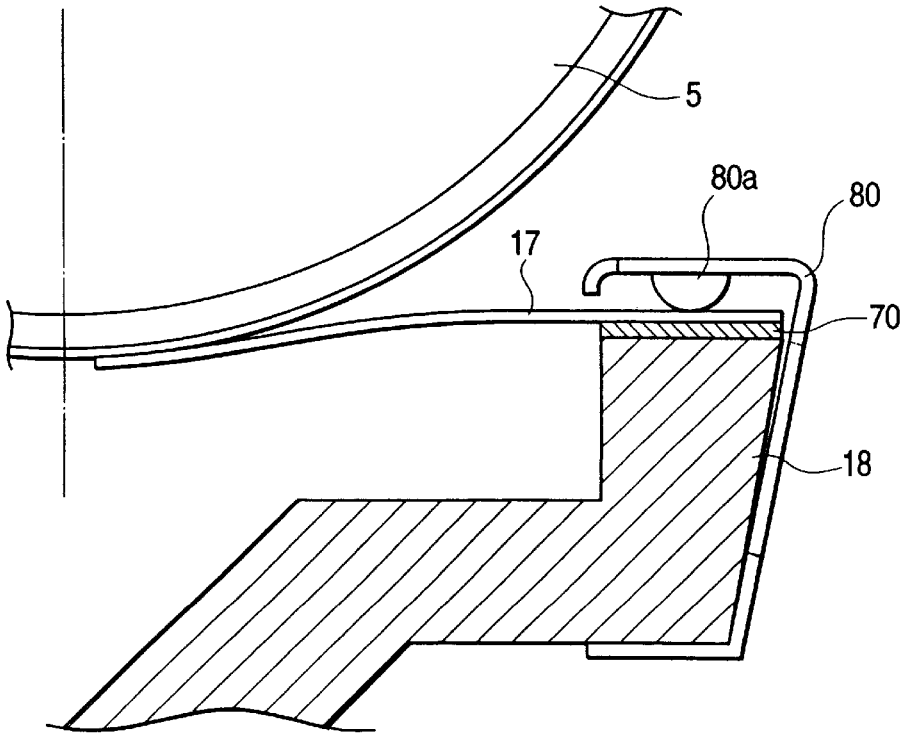
FIG. 10 is a cross-sectional view showing a variation of the fifth embodiment.

As a variation to this embodiment, it is also possible, as shown in FIG. 10, to directly mount the seal bias metal plate 70 on the upper end of the frame 18 of the developer container 14, then contact the seal member 17 thereon, and to collectively support the supporting portion of the seal member 17, the seal bias metal plate 70 and the frame 18 by the metal holder 80.

Embodiment 6

Figure 11:
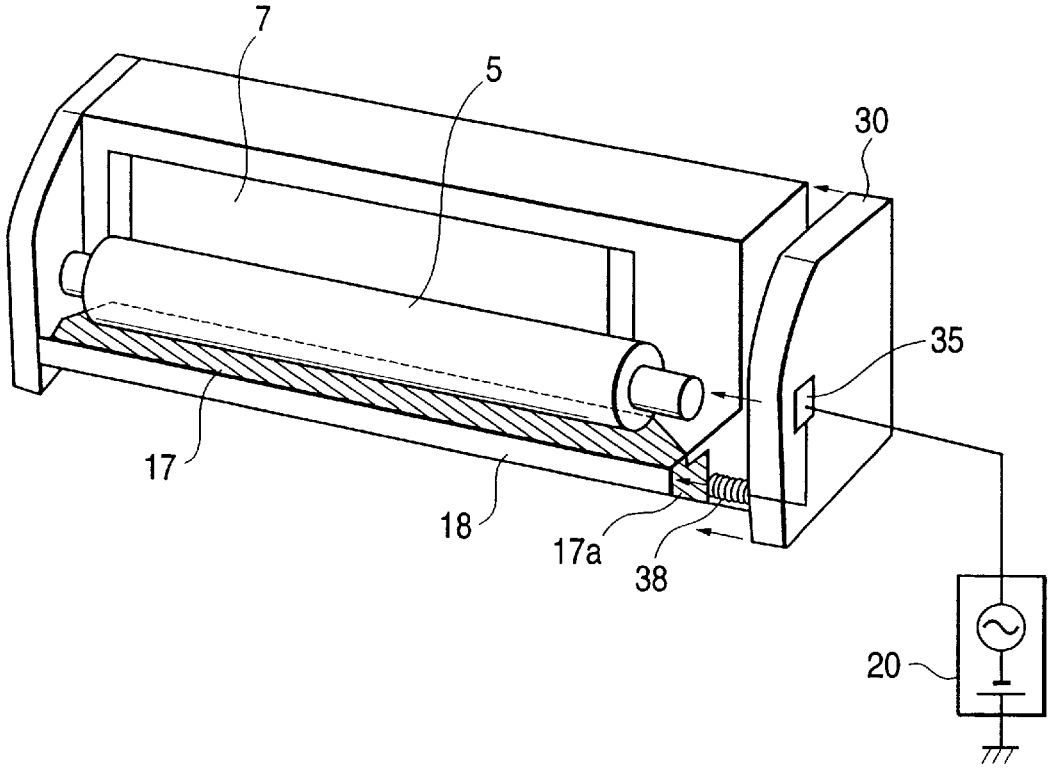
FIG. 11 is a schematic exploded perspective view showing the contact portion between the seal member and the spring contact in a sixth embodiment.

In the following there will be explained a sixth embodiment of the present invention with reference to FIG. 11.

In this embodiment, a bias supply metal plate 35 is mounted on a sleeve bearing rotatably supporting the developing sleeve 5 and is connected to the power source 20 to apply the bias voltage from the power source 20 to the developing sleeve 5. Also the sleeve bearing 30 is provided, at the side of the developing sleeve 5 thereof, with a coil spring contact 38 which is connected with the bias supply metal plate 35 and is pressed to an extension 17*a* of the seal member 17 extended to the lateral side of the frame 18 of the developer container 14 for achieving secure electrical connection, whereby the bias voltage from the power source 20 is supplied through the bias supply metal plate 35 and the coil spring contact 38 to the seal member 17.

The above-described configuration, having the bias application route from the power source 20 through the bias supply metal plate 35 and the coil spring contact 38 to the seal member 17, securely maintains the seal member and the developing sleeve 5 at the same potential, whereby the unused toner can be securely recovered at the aperture of the developing container 14 and the toner leakage can be prevented.

Embodiment 7

Figure 12:
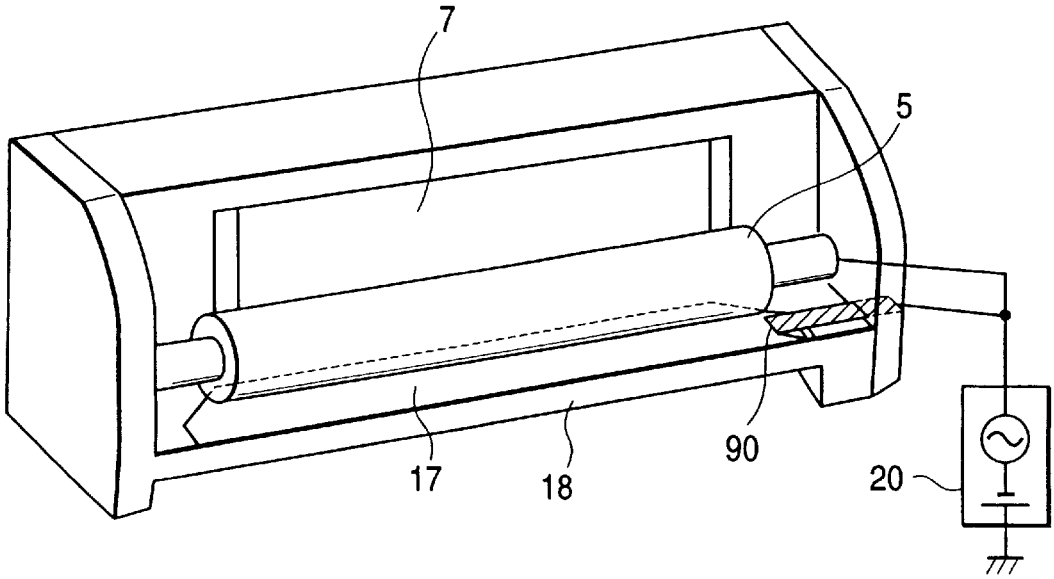
FIG. 12 is a schematic view showing the bias applying route and the seal bias metal plate of the developing apparatus of a seventh embodiment.

In the following there will be explained a seventh embodiment of the present invention with reference to FIGS. 12, 13A and 13B.

In the present embodiment, the power source 20 and the seal member 17 are connected by a seal bias metal plate 90 of which an end in contact with the seal member 17, thereby constituting an independent exclusive route for applying the bias voltage to the seal member 17. Thus the bias voltage from the power source 20 is independently applied to the developing sleeve 5 and the seal member 17 to maintain the seal member 17 at the same potential as in the developing sleeve 5, whereby the unused toner can be securely recovered at the aperture of the developer container 14 and the toner leakage can be prevented.

Figure 13A:
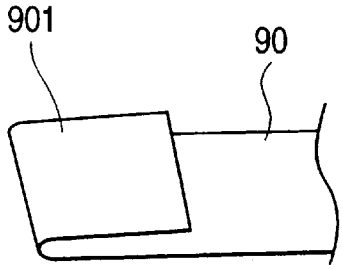
FIGS. 13A and 13B are perspective views showing contact portions of the seal bias metal plate with the seal member in the seventh embodiment.
Figure 13B:
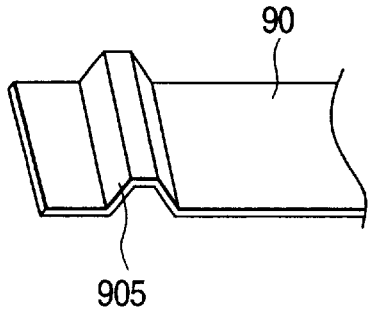

Also in the present embodiment, the contact portion of the seal bias metal plate 90 with the seal member 17 may be formed as a plate spring shaped portion 901 as shown in FIG. 13A or as a protruding shape portion 905 as shown in FIG. 13B to achieve secure conduction with the seal member 17 by a line or area contact. The seal bias metal plate 90 of the plate spring shape (FIG. 13A) or protruding shape (FIG. 13B) is seen from the side of contact.

Figure 14A:
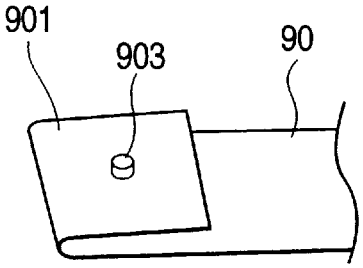
FIGS. 14A and 14B are perspective views showing variations in the contact portions of the seal bias metal plate with the seal member in the seventh embodiment.
Figure 14B:
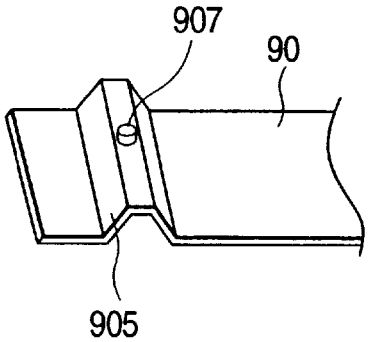

Furthermore, in the seal bias metal plate 90, the contact portion of the plate spring shape (shown in FIG. 13A) or the protruding shape (shown in FIG. 13B) may be provided with a protrusion 903 or 907 respectively, as shown in FIGS. 14A and 14B, for achieving secure point contact with the seal member 17.

Embodiment 8

Figure 15:
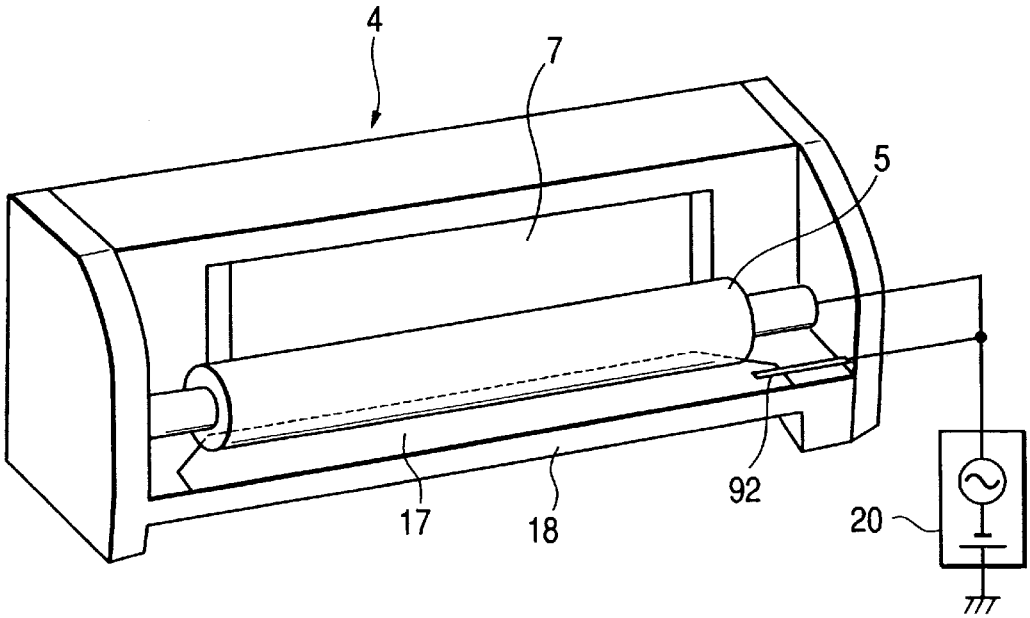
FIG. 15 is a schematic view showing a bias applying route and a cable in the developing apparatus of an eighth embodiment.

In the following there will be explained an eighth embodiment of the present invention with reference to FIG. 15.

In the present embodiment, the configuration is similar to that in the seventh embodiment but the seal bias metal plate 90 is replaced by a cable 92 of which an end is in contact with the seal member 17 for connecting the power source 20 and the seal member 17, thereby constituting an independent exclusive route for applying the bias voltage to the seal member 17. Thus the bias voltage from the power source 20 is independently applied to the developing sleeve 5 and the seal member 17 to maintain the seal member 17 at the same potential as in the developing sleeve 5.

Embodiment 9

Figure 16:
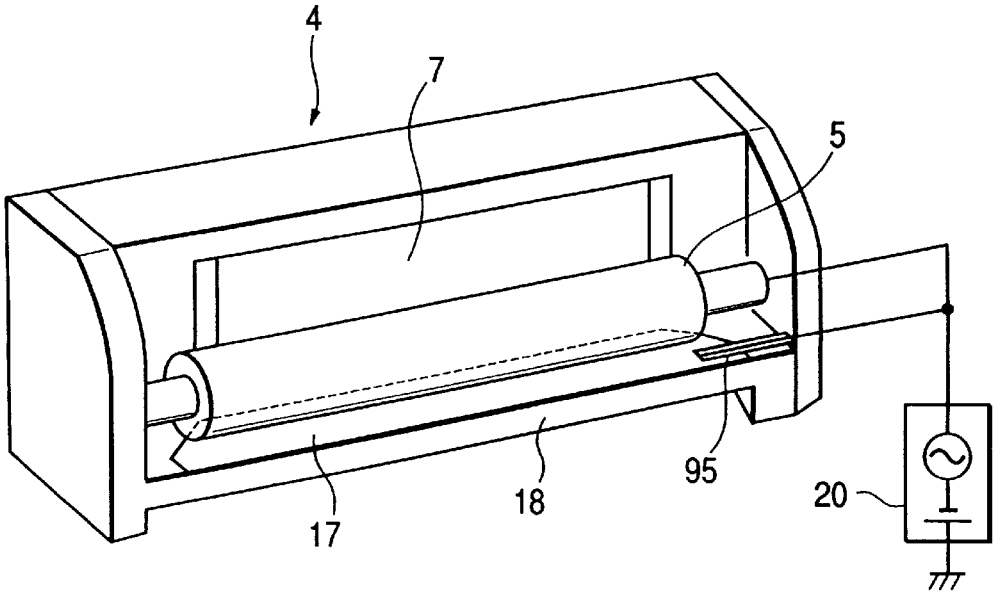
FIG. 16 is a schematic view showing a bias applying route and a flexible printed circuit board in the developing apparatus of a ninth embodiment.

In the present embodiment, the configuration is similar to that in the eighth embodiment but the cable 92 is replaced by a flexible printed circuit board 95 of which an end is in contact with the seal member 17 for connecting the power source 20 and the seal member 17 as shown in FIG. 16, thereby constituting an independent exclusive route for applying the bias voltage to the seal member 17. Thus the bias voltage from the power source 20 is independently applied to the developing sleeve 5 and the seal member 17 to maintain the seal member 17 at the same potential as in the developing sleeve 5, whereby the unused toner can be securely recovered at the aperture of the developing container 14 and the toner leakage can be prevented.

Embodiment 10

Figure 17:
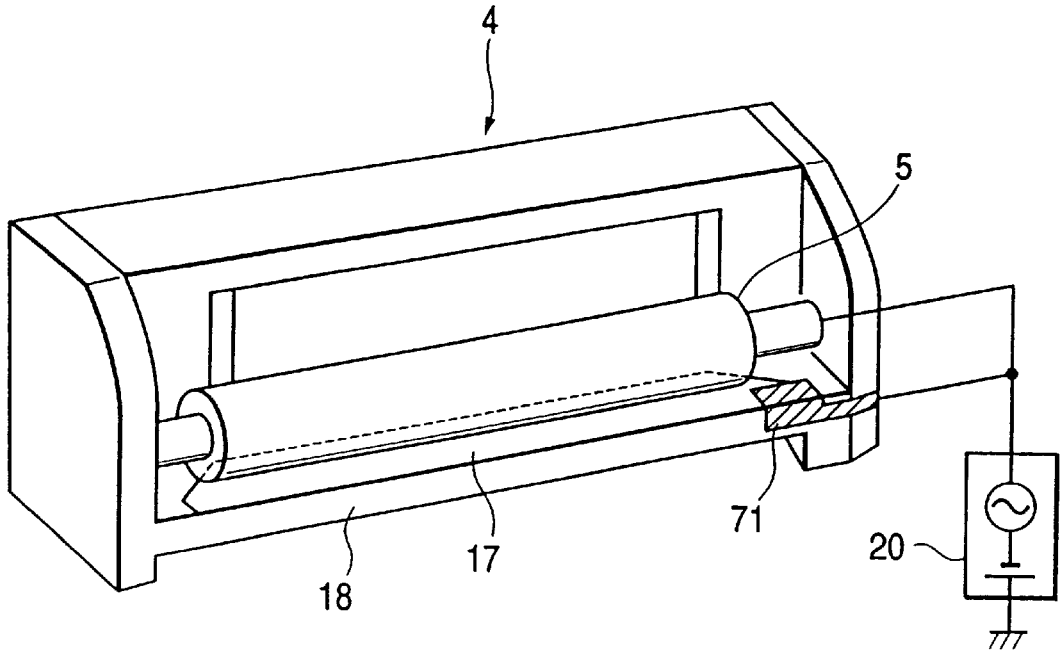
FIG. 17 is a schematic view showing a bias applying route and a seal bias metal plate in the developing apparatus of a tenth embodiment.
Figure 18:
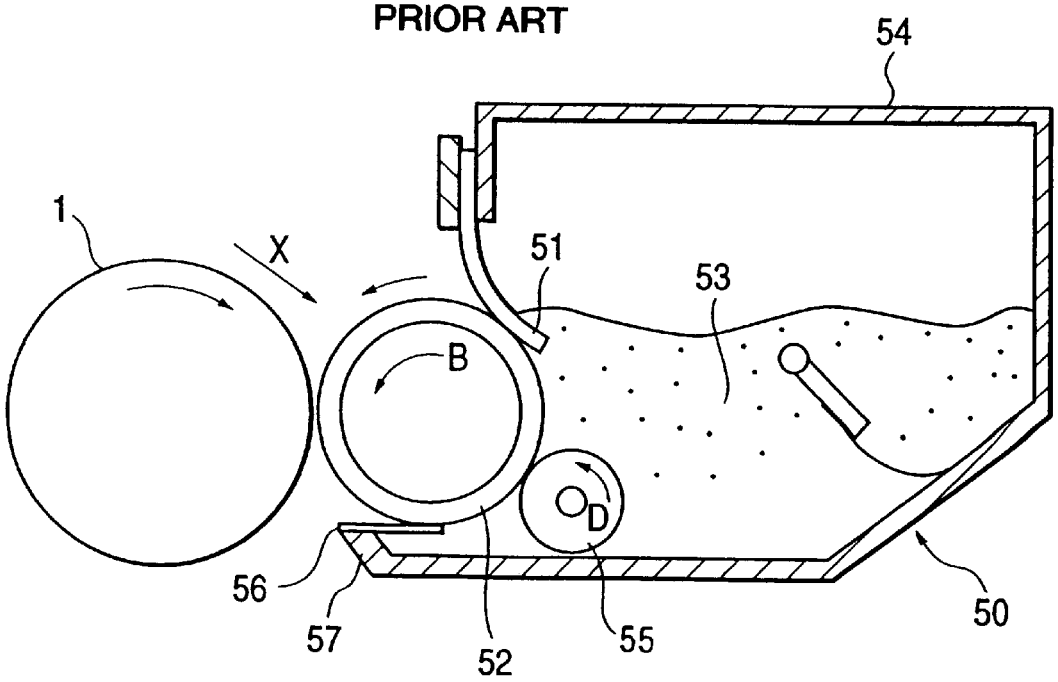
FIG. 18 PRIOR ART
FIG. 18 is a schematic view showing a conventional developing apparatus.
Figure 19:
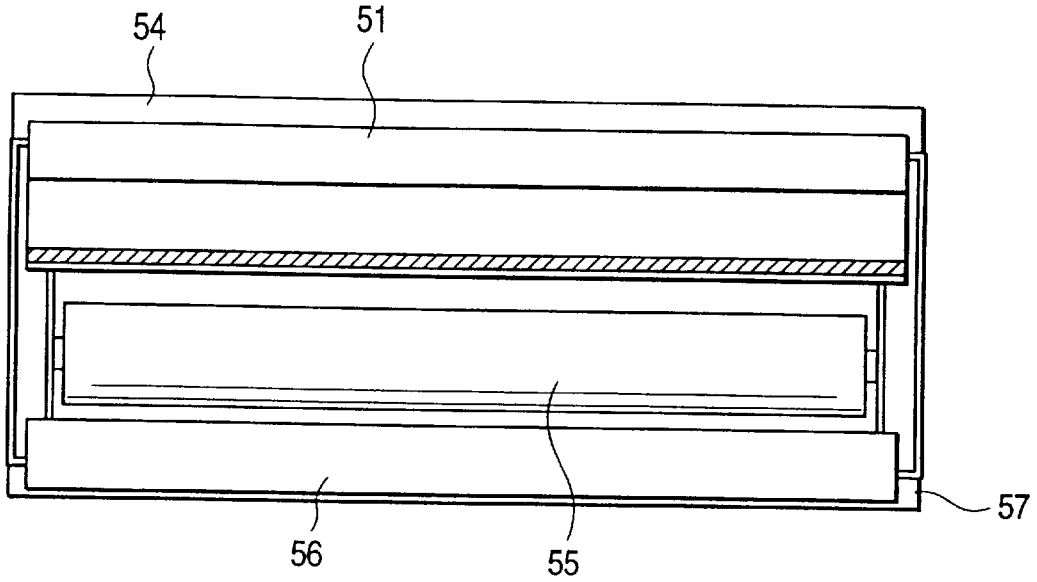
FIG. 19 PRIOR ART
FIG. 19 is a view of the developing apparatus shown in FIG. 18, without the developing sleeve, seen from a direction X shown in FIG. 18.
Figure 20:
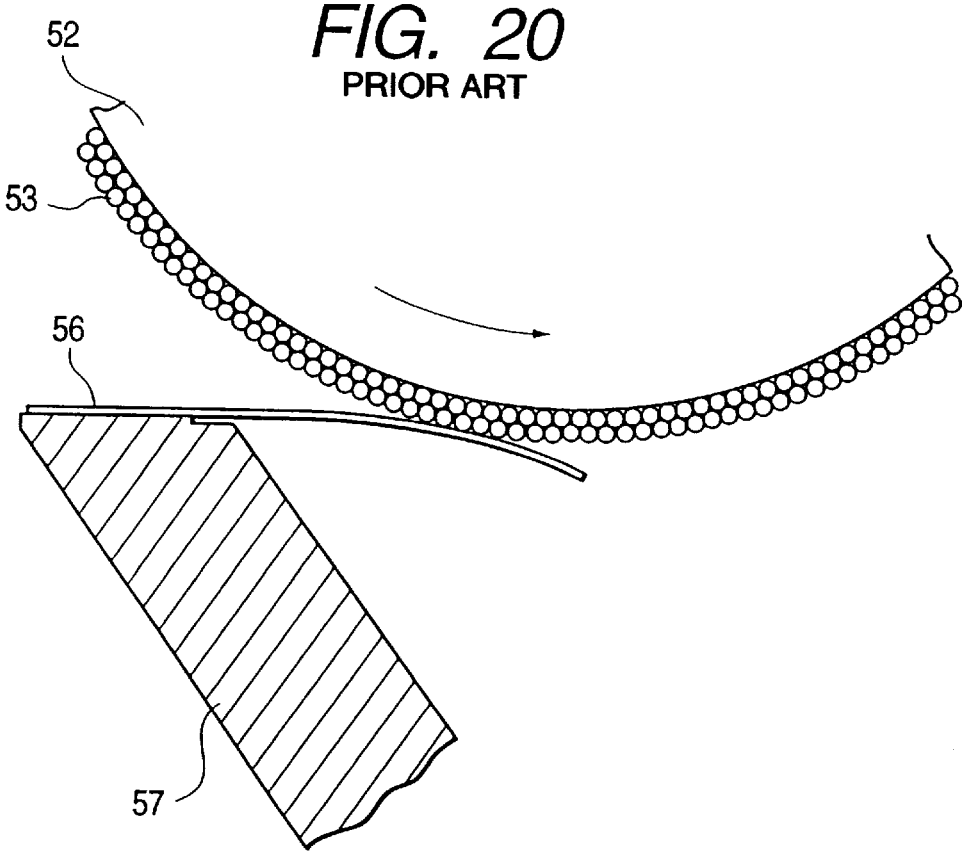
FIG. 20 PRIOR ART
FIG. 20 is a cross-sectional view showing the contact state of the developing sleeve and the seal member in the developing apparatus shown in FIG. 18.

In the following there will be explained a tenth embodiment of the present invention, with reference to FIG. 17. In the fourth embodiment, as explained with reference to FIG. 8, the seal bias metal plate 70 is connected to the seal member 17 through the side opposed to the photosensitive drum 1, namely the rear side of the developing sleeve 5. Thus there are obtained two routes for applying the bias voltage to the seal member 17, namely a route from the power source 20 through the developing sleeve 5 to the seal member 17 and an exclusive route from the power source 20 through the seal bias metal plate 70 to the seal member 17 whereby the seal member 17 can be securely maintained at the potential the same as that of the developing sleeve 5 while the seal bias metal plate 70 is positioned at the rear side of the developing sleeve 70 for space saving.

On the other hand, in the present embodiment, the configuration is similar to that of the fourth embodiment but the seal bias metal plate 71 is provided at a side opposite to the photosensitive drum 1 and at the outside of the developing sleeve 5 for the purpose of space saving and for improving productivity.

Also in the present embodiment, the seal member 17 can be securely maintained at the same potential as in the developing sleeve 5.

As will be apparent from the foregoing description, the developer sealing member is provided with a conductive material in the entire contact area or a part thereof with the developer bearing member, whereby, at the application of the bias voltage, the developer sealing member assumes a potential the same as that of the developer bearing member. It is therefore provided a developing apparatus capable of securely recovering the unused developer from the developer bearing member after the developing operation, at the aperture, thereby preventing developer leakage, a process cartridge containing at least such developing apparatus, and an image forming apparatus equipped with such developing apparatus.

Also the above-mentioned developer sealing member is adhered to an adhering portion of the developing container, in a state in which the adhering portion is elastically deformed. It is therefore possible to prevent deterioration of the sealing ability, resulting from the deformation of the developer sealing member caused by the deformation of the developing apparatus induced by repetition of the developing operation. It is thus rendered possible to provide a developing apparatus capable of preventing toner leakage, a process cartridge containing at least such developing apparatus, and an image forming apparatus equipped with such developing apparatus or process cartridge.

What is claimed is:

1. A developing apparatus comprising:

a developer container, provided with an aperture, for containing developer;

a developer bearing member, provided at the aperture, for bearing and conveying the developer; and a developer sealing member in contact with a surface of said developer bearing member for preventing leakage of the developer from the aperture;

wherein at least a part of said developer sealing member is a conductive portion, said developer bearing member and the conductive portion having a same potential when a voltage is applied to said developer bearing member, and wherein said developer sealing member is provided with an insulating layer in contact with said developer bearing member, and the conductive portion is provided at a side opposite to the side where the insulating layer is in contact with said developer bearing member.

2. A developing apparatus according to claim 1, wherein said developer sealing member is supported by said developer container.

3. A developing apparatus according to claim 2, wherein said developer sealing member is attached to an attaching portion of said developer container in such a manner that a tension is generated in a longitudinal direction of said developer bearing member.

4. A developing apparatus according to claim 1, wherein said developer sealing member is supported by a part of said developer container positioned below said developer bearing member.

5. A developing apparatus according to claim 1, wherein said developer sealing member has elasticity.

6. A developing apparatus according to claim 1, wherein, in a longitudinal direction of said developer bearing member, said developer sealing member has a width larger than width of a developing area.

7. A developing apparatus according to claim 1, wherein said developer sealing member is provided in a position wherein a surface of said developer bearing member enters into said developer container after said developer bearing member effects a developing operation.

8. A developing apparatus according to claim 1, wherein the conductive portion is in electrical contact with said developer bearing member at an outside of a developing area in a longitudinal direction of said developer bearing member.

9. A developing apparatus according to claim 1, wherein a first route exclusively for electrical conduction to said developer sealing member and a second route for electrical conduction by contact with said developer bearing member at an outside of a developing area in a longitudinal direction of said developer bearing member are provided as routes for applying a voltage to said developer sealing member.

10. A developing apparatus according to claim 1, wherein a contact for applying a voltage to said developer sealing member is composed of a metal plate or a coil spring.

11. A developing apparatus according to claim 1, wherein a surface of said developer sealing member in contact with said developer bearing member is a surface on a side which is entered into a mold when said developer sealing member is formed by a mold.

12. A developing apparatus according to claim 1, wherein said developing apparatus constitutes a process cartridge detachably attachable to an image forming apparatus together with an image bearing member.

13. A developing apparatus according to claim 1, wherein said developing apparatus is provided in an image forming apparatus having an image bearing member and develops with the developer, an electrostatic image formed on said image bearing member.

14. A developing apparatus comprising:

a developer container, provided with an aperture, for containing developer;

a developer bearing member, provided at the aperture, for bearing and conveying the developer; and a developer sealing member in contact with a surface of said developer bearing member for preventing leakage of the developer from the aperture, and wherein said developer sealing member includes an insulating sheet and a conductive portion, said developer bearing member and said conductive portion having a same potential when a voltage is applied to said developer bearing member.

15. A developing apparatus according to claim 14, wherein said developer sealing member is supported by said developer container.

16. A developing apparatus according to claim 15, wherein said developer sealing member is attached to an attaching portion of said developer container in such a manner that a tension is generated in a longitudinal direction of said developer bearing member.

17. A developing apparatus according to claim 14, wherein said developer sealing member is supported by a part of said developer container positioned below said developer bearing member.

18. A developing apparatus according to claim 14, wherein said developer sealing member has elasticity.

19. A developing apparatus according to claim 14, wherein said developer sealing member is provided in a position wherein a surface of said developer bearing member enters into said developer container after said developer bearing member effects a developing operation.

20. A developing apparatus according to claim 14, wherein the conductive portion is in electrical contact with said developer bearing member outside of a developing area in a longitudinal direction of said developer bearing member.

21. A developing apparatus according to claim 14, wherein a first route exclusively for said developer sealing member and a second route for electrical conduction by contact with said developer bearing member outside of a developing area in a longitudinal direction of said developer bearing member are provided as routes for applying a voltage to said developer sealing member.

22. A developing apparatus according to claim 14, wherein said developing apparatus constitutes a process cartridge detachably attachable to an image forming apparatus together with an image bearing member.

* * * * *

UNITED STATES PATENT AND TRADEMARK OFFICE

CERTIFICATE OF CORRECTION

PATENT NO. : 6,144,820
DATED : November 7, 2000
INVENTOR(S) : Yasuyuki Ishii, et al.

It is certified that error appears in the above-identified patent and that said Letters Patent is hereby corrected as shown below:

Column 1,
Line 63, "no" should read -- not --.

Column 2,
Line 9, "force. To be utilized more" should read -- force to be utilized. More --;
Line 50, "inclose" should read -- in close --;
Line 51, "or events" should read -- prevents --; and
Line 61, "57" should read -- 57, --.

Column 3,
Line 17, ""developer" should read -- developer container --; and
Line 18, "the" (first occurrence) and "container" should be deleted.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*